US011396831B2

(12) United States Patent
Barve

(10) Patent No.: US 11,396,831 B2
(45) Date of Patent: Jul. 26, 2022

(54) ADVANCE LOCKED SPOOL VALVE PUMP PHASER WITH HYDRAULIC DETENT VALVE

(71) Applicant: BorgWarner, Inc., Auburn Hills, MI (US)

(72) Inventor: Anand Barve, Ithaca, NY (US)

(73) Assignee: BorgWarner, Inc., Auburn Hills, MI (US)

( * ) Notice: Subject to any disclaimer, the term of this patent is extended or adjusted under 35 U.S.C. 154(b) by 0 days.

(21) Appl. No.: 17/245,465

(22) Filed: Apr. 30, 2021

(65) Prior Publication Data

US 2021/0324771 A1 Oct. 21, 2021

(51) Int. Cl.
*F01L 1/344* (2006.01)

(52) U.S. Cl.
CPC ..... *F01L 1/3442* (2013.01); *F01L 2001/3443* (2013.01); *F01L 2001/34426* (2013.01); *F01L 2001/34453* (2013.01); *F01L 2001/34459* (2013.01); *F01L 2001/34463* (2013.01); *F01L 2800/01* (2013.01); *F01L 2800/04* (2013.01)

(58) Field of Classification Search
None
See application file for complete search history.

(56) References Cited

U.S. PATENT DOCUMENTS

| | | | | |
|---|---|---|---|---|
| 9,080,471 | B2 * | 7/2015 | Pluta | F01L 1/34409 |
| 2013/0180486 | A1 * | 7/2013 | Smith | F01L 1/047 123/90.17 |
| 2018/0073402 | A1 * | 3/2018 | Smith | F01L 1/34409 |
| 2019/0003348 | A1 * | 1/2019 | Smith | F01L 1/34409 |

* cited by examiner

*Primary Examiner* — Devon C Kramer
*Assistant Examiner* — Wesley G Harris
(74) *Attorney, Agent, or Firm* — Brown & Michaels, PC

(57) ABSTRACT

A phaser which has three camshaft start positions at start-up during cranking before the engine can fire. By having three possible start positions of the phaser, there is an increase in flexibility of the cam position at startup during cranking. The three start positions can also be achieved in open loop, reducing the complexity of the control system needed at cranking.

13 Claims, 12 Drawing Sheets

ADVANCE LOCKED SPOOL VALVE PUMP PHASER WITH HYDRAULIC DETENT VALVE

BACKGROUND

The present invention relates to variable cam timing phaser, and more specifically to an end position locked spool valve pump (SVP) phaser with a hydraulic detent valve.

Internal combustion engines have employed various mechanisms to vary the relative timing between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). Vane phasers have a rotor assembly with one or more vanes, mounted to the end of the camshaft, surrounded by a housing assembly with the vane chambers into which the vanes fit. It is possible to have the vanes mounted to the housing assembly, and the chambers in the rotor assembly, as well. The housing's outer circumference or other portion of the housing assembly forms the sprocket, pulley or gear accepting drive force through a chain, belt, or gears, usually from the crankshaft, or possible from another camshaft in a multiple-cam engine.

In cam torque actuated (CTA) variable camshaft timing (VCT) systems, cam torques from the engine are used to move the one or more vanes and fluid is recirculated between the working chambers without exhausting the fluid to sump. A lock pin for locking and unlocking the movement between the housing assembly and the rotor assembly can be controlled by a control valve. During engine shutdown, the control valve is moved to a position such that fluid is maintained within the chambers via recirculation, and any fluid feeding to the lock pin is vented from the circuit through the control valve.

During engine cranking or shortly thereafter, there may not be sufficient oil pressure to release the lock pin because the engine's oil passages, including those leading to the phaser may have drained. Time is required for the oil pump, which is driven by the rotation of the engine, to re-fill and build pressure in the engine's oil circuit.

Apart from the camshaft torque actuated (CTA) variable camshaft timing (VCT) systems, the majority of hydraulic VCT systems operate under two principles, oil pressure actuation (OPA) or torsional assist (TA). In the oil pressure actuated VCT systems, a control valve directs engine oil pressure to one working chamber in the vane phaser while simultaneously venting the opposing working chamber defined by the housing assembly, the rotor assembly, and the one or more vanes. This creates a pressure differential across one or more of the vanes to hydraulically push the vane phaser in one direction or the other. Neutralizing or moving the control valve to a null position puts equal pressure on opposite sides of the one or more vanes and holds the vane phaser in any intermediate position. If the vane phaser is moving in a direction such that valves of the engine will open or close sooner, the vane phaser is said to be advancing and if the vane phaser is moving in a direction such that valves will open or close later, the vane phaser is said to be retarding.

The torsional assist (TA) systems operates under a similar principle with the exception that it has one or more check valves to prevent the vane phaser from moving in a direction opposite than being commanded, should it incur an opposing force such as torque.

The problem with OPA or TA systems is that the control valve defaults to a position that exhausts all the oil from either the advance or retard working chambers and fills the opposing chamber. In this mode, the vane phaser defaults to moving in one direction to an extreme stop where a lock pin engages, locking the movement of the rotor assembly relative to the housing assembly. The OPA or TA systems are unable to direct the vane phaser to any other position during the engine start cycle when the engine is not developing any oil pressure. This limits the vane phaser to being able to move in one direction only in the engine shut down. In the past this was acceptable because at engine shut down and during engine start the vane phaser would be commanded to lock at one of the extreme travel limits (either full advance or full retard).

Most engines with an intake phaser place the phaser in the retard position in engine shutdown using a lock pin or a series of lock pins, in preparation for the next start of a "stop-start mode" which automatically stops and automatically restarts the internal combustion engine to reduce the amount of time the engine spends idling when the vehicle is stopped, for example at a stop light or in traffic. This stopping of the engine is different than a "key-off" position or manual stop via deactivation of the ignition switch in which the user of the vehicle shuts the engine down or puts the car in park and shuts the vehicle off. In "stop-start mode", the engine stops as the vehicle is stopped, then automatically restarts in a manner that is nearly undetectable to the user of the vehicle. In the past, vehicles have been designed primarily with cold starts in mind, since that is the most common situation. In a stop-start system, because the engine had been running until the automatic shutdown, the automatic restart occurs when the engine is in a hot state. It has long been known that "hot starts" are sometimes a problem because the engine settings necessary for the usual cold start—for example, a particular valve timing position—are inappropriate to a warm engine.

Unlocking the lock pin is dependent upon engine oil pressure available at start up.

SUMMARY

According to one embodiment of the present invention, a phaser of the present invention has three camshaft start positions which can be used at start-up during cranking before the engine can fire. The three camshaft start positions are full advance, full retard, and intermediate position. By having three possible start positions of the phaser, there is an increase in flexibility of the cam position at startup during cranking. The three start positions can also be achieved in open loop, reducing the complexity of the control system needed at cranking.

The determination of the which of the three camshaft start positions the phaser is moved to during cranking is determined based on a number of factors, which can include fuel type, grade of fuel, engine oil temperature, and altitude.

In general, the phasing speed of the camshaft in a retard direction is always greater than the advance direction because of cam friction. Cam friction is typically much higher at colder temperatures and at cranking rpm, making advancing under those conditions more difficult than retarding. Therefore, it is advantageous to park (with engine shutoff) the phaser in full advance position, so that if actuation is demanded during cranking, the phaser only has to move in retard direction and hence can reach target cam phase angle before engine starts quickly. If the engine control unit (ECU) wants the cam phaser to be in full advance before engine start the phaser is already in the full advance position (parked position). If the ECU wants cam position to be in full retard before engine start the phaser can move quickly to full retard stop. It is also noted that the phaser can alternatively be parked in the full retard position and the phaser moved to another position as demanded by the ECU.

Additionally, by adding the hydraulic detent circuit to the phaser, the phaser can be moved to a mid-position in a retard direction at cranking, giving an additional start position option between the two end stops. Furthermore, the addition of a spool valve pump provides a method of unlocking the lock pin if needed at cranking rpm when engine oil pressure is low or unavailable.

DETAILED DESCRIPTION

Figure 1:
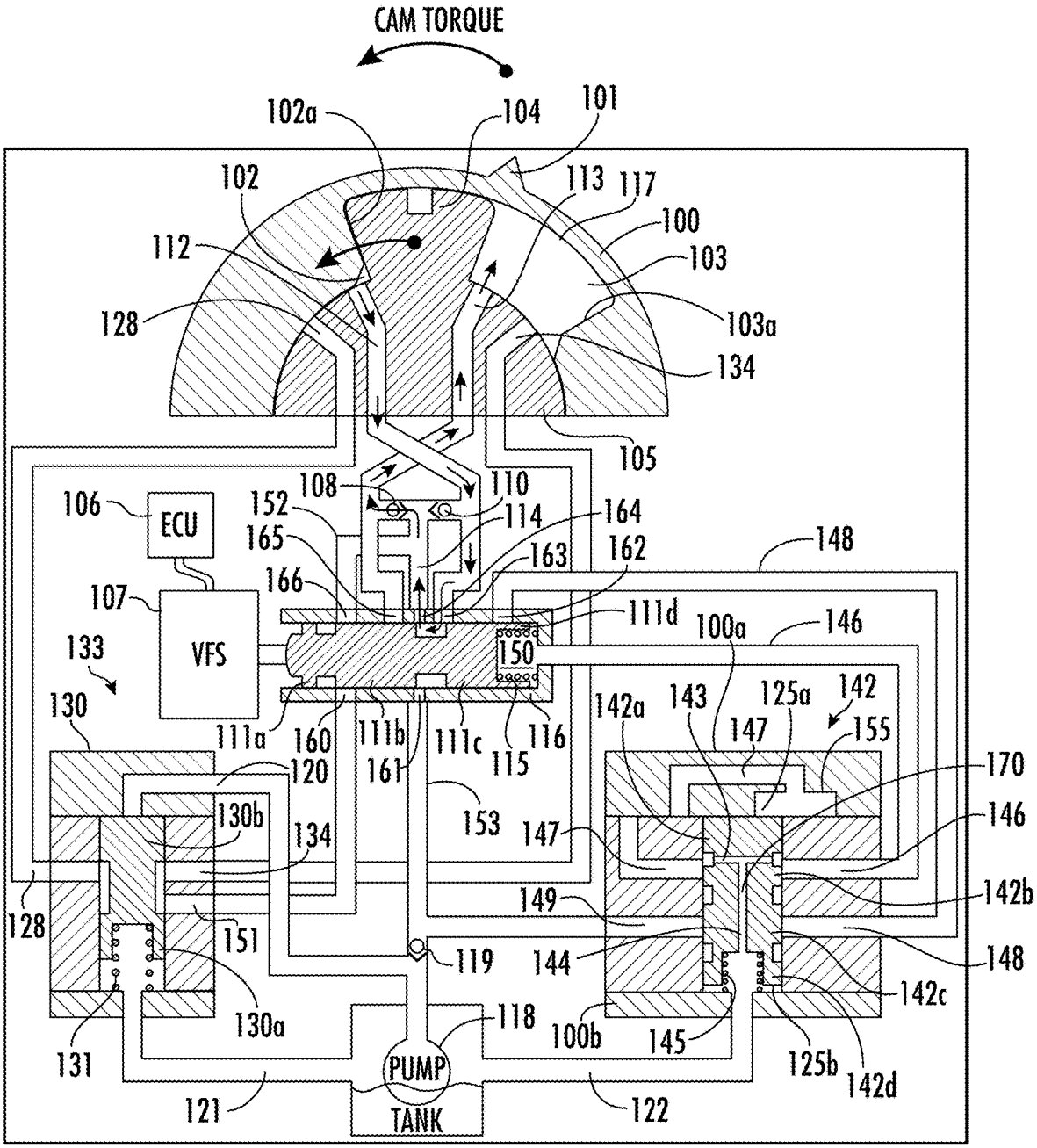
FIG. 1 shows a schematic of a VCT phaser at cranking moving toward a retard position by cam torque with the lock pin being unlocked.

The present invention includes a variable cam timing (VCT) phaser which has three different startup position options at the time of cranking before the engine fires. The different VCT phaser positions allow the camshaft to at an optimum position for engine restarts in various conditions. The determination by the ECU as to what position to command the VCT phaser to is based on sensor data which can include fuel type, grade of fuel, engine oil temperature, and altitude.

The VCT phaser includes a lock pin for locking the housing assembly relative to the rotor assembly of the VCT phaser. The lock pin is biased towards a locked position, in which the lock pin engages an inner end plate or an outer end plate of the housing assembly mainly by a spring. The lock pin is biased towards an unlocked position, in which the lock pin disengages the inner end plate or outer end plate of the housing assembly by oil pressure supplied from a spool valve pump.

The VCT phaser additionally includes a control valve that can be moved to a detent mode and a hydraulic detent circuit to direct the VCT phaser in either direction, advance or retard via detent valve to move the phaser to specific positions.

The figures show the operating modes the VCT phaser depending on the spool valve position of the control valve. The positions shown in the figures define the direction the VCT phaser is moving to. It is understood that the control valve has an infinite number of intermediate positions, so that the control valve not only controls the direction the VCT phaser moves but, depending on the discrete spool position, controls the rate at which the VCT phaser changes positions. Therefore, it is understood that the control valve can also operate in infinite intermediate positions and is not limited to the positions shown in the Figures.

FIGS. 1-8 show the VCT phaser at cranking moving towards various position.

The housing assembly 100 of the phaser has an outer circumference 101 for accepting a drive force. Alternatively, acceptance of the drive force is through an end plate of the housing assembly 100. The housing assembly 100 of the phaser includes an inner face plate 100*a* and an outer face plate 100*b*. The rotor assembly 105 is connected to the camshaft (not shown) and is coaxially located within the housing assembly 100. The rotor assembly 105 has at least one vane 104 separating a chamber 117 with an advance wall 102*a* and a retard wall 103*a* formed between the housing assembly 100 and the rotor assembly 105 into working chambers such as an advance chamber 102 and a retard chamber 103. The vane 104 is capable of rotation to shift the relative angular position of the housing assembly 100 and the rotor assembly 105.

Figure 8:
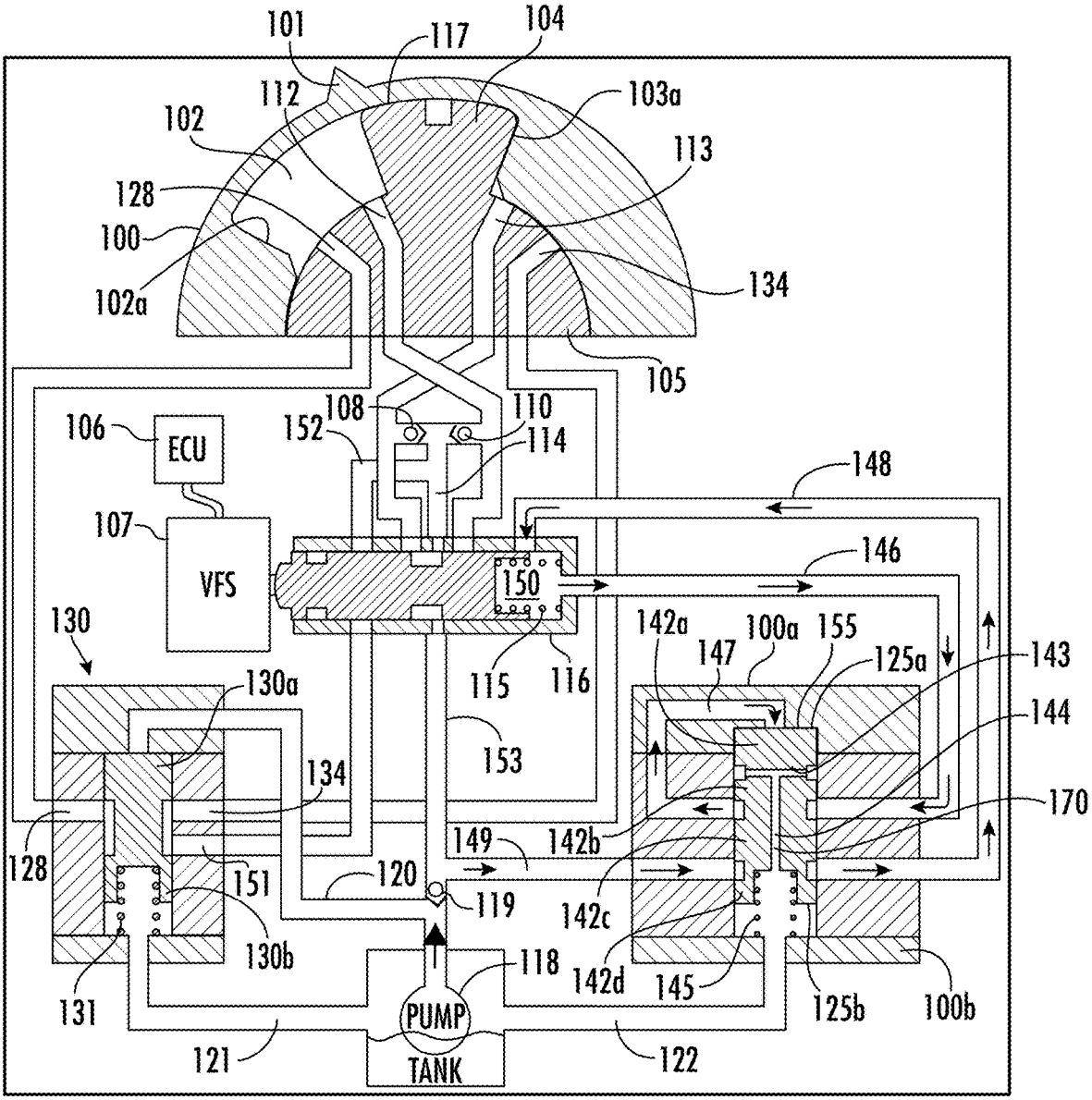
FIG. 8 shows a schematic of a VCT phaser at cranking in a full advance position, with the lock pin being locked and ready to unlock using the spool valve pump.

A lock pin 142 is slidably housed in a bore 141 in the rotor assembly 105 and has a plurality of cylindrical lands, 142*a*, 142*b*, 142*c*, 142*d*. The lock pin 142 has a first, unlocked position in which the first end portion 125*a* of the lock pin 142 does not engage the recess 155 and a second, locked position in which the first end portion 125*a* of the lock pin 142 engages the recess 155, locking the relative movement of the rotor assembly 105 relative to the housing assembly 100. The second end 125*b* of the lock pin 142 is in fluid communication with tank. Depending on the position of the lock pin 142, the recess 155 is in fluid communication with the control valve 109 and more specifically the spool valve pump 150, as well as with inlet supply 118 via line 149. The lock pin 142 additionally has a t-shaped internal passage 170. The t-shaped internal passage 170 has a horizontal portion 143 and a vertical portion 144 within the lock pin 142. Depending on the position of the lock pin 142, the t-shaped internal passage 170 connects line 146 to passage 147 between the first land 142*a* and the second land 142*b* of the lock pin 142, such that fluid can reach passage 147 to bias the lock pin against spring 145 and move to an unlock position. Therefore, pressurization of the lock pin 142 is controlled by the switching/movement of the control valve 109 as well as inlet supply 118 from the oil gallery. The first end 125*a* of the lock pin 142 is biased towards and fits into a recess 155 in the inner plate 100*a* of the housing assembly 100 by a spring 145, for example as shown in FIG. 8.

While note shown, the lock pin 142 may be alternatively housed in the housing assembly 100 and be spring 145 biased towards a recess 155 in the rotor assembly 105.

Typically, during engine cranking, after an engine shutdown, there is no oil pressure present to unlock the lock pin 142 and no phasing can begin until after the lock pin 142 has been pressure biased to an unlocked position.

A control valve 109, preferably a spool valve, includes a spool 111 with a plurality of cylindrical lands 111*a*, 111*b*, 111*c* is slidably received in a sleeve 116 within a bore in the rotor assembly 105 and pilots in the camshaft (not shown). The control valve 109 may be located remotely from the phaser, within a bore in the rotor assembly 105 which pilots in the camshaft, or in a center bolt of the phaser, with or without a sleeve, such that the center belt acts as the sleeve.

The sleeve 116 of the control valve 109 has a series of ports 160-166. Port 160 is in fluid communication the detent valve 130 of the hydraulic detent circuit. Port 161 is in fluid communication with inlet supply 118 via line 153. Fill port 162 is in fluid communication with line 148. In addition, fill port 162 is in communication with spool valve pump chamber 150 during engine shutdown, engine cranking and engine stop. Port 163 is in fluid communication with the advance line 112. Port 164 is in fluid communication with common line 114. Port 165 is in fluid communication with retard line 113. Port 166 is in fluid communication with line 152 which connects to common line 114.

One end of the spool 111 contacts spring 115 and the opposite end of the spool 111 contacts a variable force solenoid (VFS) 107. The solenoid 107 may also be linearly controlled by varying current or voltage or other methods as applicable. Between the end of the spool 111 which contacts the spring 115 and the inner diameter 116*a* of the sleeve 116 is formed a spool valve pump chamber 150. The spool valve pump chamber 150 stores supply oil during engine shutdown and engine stop where the pump chamber 150 is filled and the pressure of the oil in this spool valve pump chamber 150 is pumped up or increased in pressure by the movement of the spool 111. The spool valve pump chamber 150 is also in fluid communication with lock pin 142, for example via line 146 and line 148.

The detent circuit is kept on when there is no oil pressure, such as during engine cranking and engine stop.

A pump chamber circuit is comprised of a supply lines 143, 149, 148, 146, 147, 122 in fluid communication with the lock pin 142, the lock pin 142, and the pump chamber 150, line 146 in fluid communication with pump chamber 150 and the lock pin 142. The pump chamber 150 fills by decaying oil pressure as engine oil pressure drops in line 148. The filling occurs as soon as the spool valve 111 moves to a full out position, such that fill port 162 is open.

The pump chamber circuit is filled during engine shutdown (idle to stop). All fluid associated with the lock pin 142, such that any fluid present in lines 147 and 155 gets pushed back into the spool valve pump chamber 150 and any fluid present in the phaser itself drains back into the pump chamber 150. Residual pressure from the oil system fills the pump chamber circuit until either the pressure is no longer sufficient to force fluid into the pump chamber 150 or the pump chamber 150 is full or the pressure in passage 148 and spool valve pump chamber 150 is the same.

The position of the control valve 109 is controlled by an engine control unit (ECU) 106 which controls the duty cycle of the variable force solenoid 107. The ECU 106 preferably includes a central processing unit (CPU) which runs various computational processes for controlling the engine, memory, and input and output ports used to exchange data with external devices and sensors. For example, sensors can at least provide one or more of altitude, fuel type, engine oil pressure temperature, engine oil pressure, position of the phaser, position of the camshaft and position of the crankshaft.

The position of the spool 111 is influenced by spring 115 and the solenoid 107 controlled by the ECU 106. Further detail regarding control of the VCT phaser is discussed in detail below. The position of the spool 111 controls the motion (e.g. to move towards the advance position, holding position, or the retard position) during idle and other position during cranking of the VCT phaser as well as what fluid is used to lock or unlock the lock pin 142.

A hydraulic detent circuit 133 is also present and includes a spring 131 loaded detent valve 130, an advance detent line 128 that connects the advance chamber 102 to the detent valve 130 and the common line 114 when the detent valve 130 is in a first position (on), and a retard detent line 134 that connects the retard chamber 103 to the detent valve 130 and the common line 114 when the detent valve is in a first position (on). The advance detent line 128 and the retard detent line 134 are present within the vane 104. In a second position (oft), the retard detent line 134 or the advance detent line 128 are not connected to the common line 114.

The phaser has a CTA retard cranking mode, a detent cranking mode, a full advance cranking mode, an advance mode, a retard mode, and a null mode. The advance mode, retard mode, and null mode take place during idling or greater, which occurs after cranking.

In the advance mode during engine idling, the spool 111 is moved to a position so that fluid may flow from the retard chamber 103 into the spool 111 and through the advance recirculating check valve 110 into advance line 112 and into advance chamber 102. Fluid is blocked from exiting the advance chamber 102 through detent line 128 via detent valve 130. Fluid from inlet supply 118 is additionally supplied to bias the detent valve 130 to a position such that line 128 is blocked and the detent circuit is off. The lock pin 142 is unlocked.

In the retard mode during engine idling, the spool 111 is moved to a position so that fluid may flow from the advance chamber 102 through the spool 111 and through the retard recirculating check valve 108 into retard line 113 and into the retard chamber 103. Fluid is blocked from exiting the retard chamber 103 and via the detent line 134 of the detent valve 130. Fluid from the inlet supply 118 is additionally supplied to bias the detent valve 130 to a position such that line 134 is blocked and the hydraulic detent circuit is off. The lock pin 142 is in an unlocked position.

In null or holding mode during engine idling, the spool 111 is moved to a position that blocks the exit of fluid from the advance and retard chambers 102, 103. Fluid is supplied to the detent valve 130 from inlet supply 118 and the detent valve circuit is off. The lock pin 4142 is unlocked.

In the detent cranking mode, two functions occur simultaneously. The first function in the detent mode is that the spool 111 moves to a position in which spool land 111*b* blocks the flow of fluid from supply line 153, port 164 (spool is full in).

The second function in detent mode is to open or turn on the detent valve circuit 133. The detent valve circuit 133 has complete control over the phaser moving to advance or retard, until the vane 104 reaches the intermediate phase angle position, such that the advance detent line 128 is connected to line 151.

The intermediate phase angle position or mid-position is when the vane 104 is somewhere between the advance wall 102*a* and the retard wall 103*a* defining the chamber between the housing assembly 100 and the rotor assembly 105. The intermediate phase angle position can be anywhere between the advance wall 102*a* and retard wall 103*a* and is determined by where the advance detent line 128 and the retard detent line 134 are placed relative to the vane 104.

Prior to the advance mode, retard mode and null mode at idling, the phaser is moved to a position during cranking before engine starts or fires to allow the VCT phaser to reach the appropriate mode for idling as quickly as possible. In a first option, during cranking, the VCT phaser is maintained at either a retard, advance or null mode via cam torque and the lock pin is moved to an unlocked position in a CTA retard cranking mode. In a second option, the VCT phaser is moved to a mid-position and the lock pin is moved to an unlocked position in a detent cranking mode. In a third option, the VCT phaser is moved to a full advance position, with the lock pin in a locked position, ready to be unlocked by the spool valve pump in a full advance cranking mode.

Figure 2:
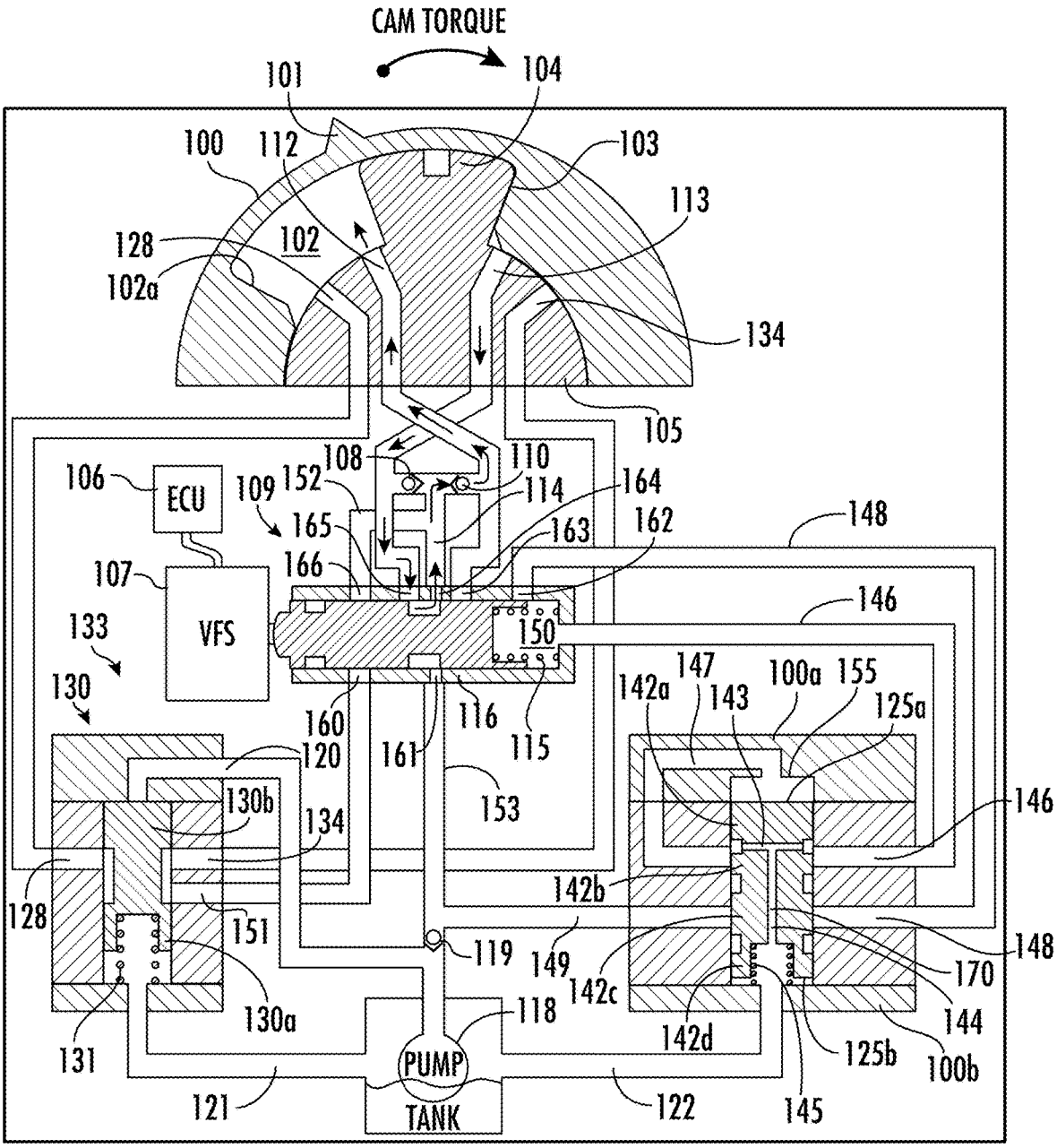
FIG. 2 shows a schematic of a VCT phaser at cranking moving toward an advance position by cam torque with the lock pin being unlocked.
Figure 3:
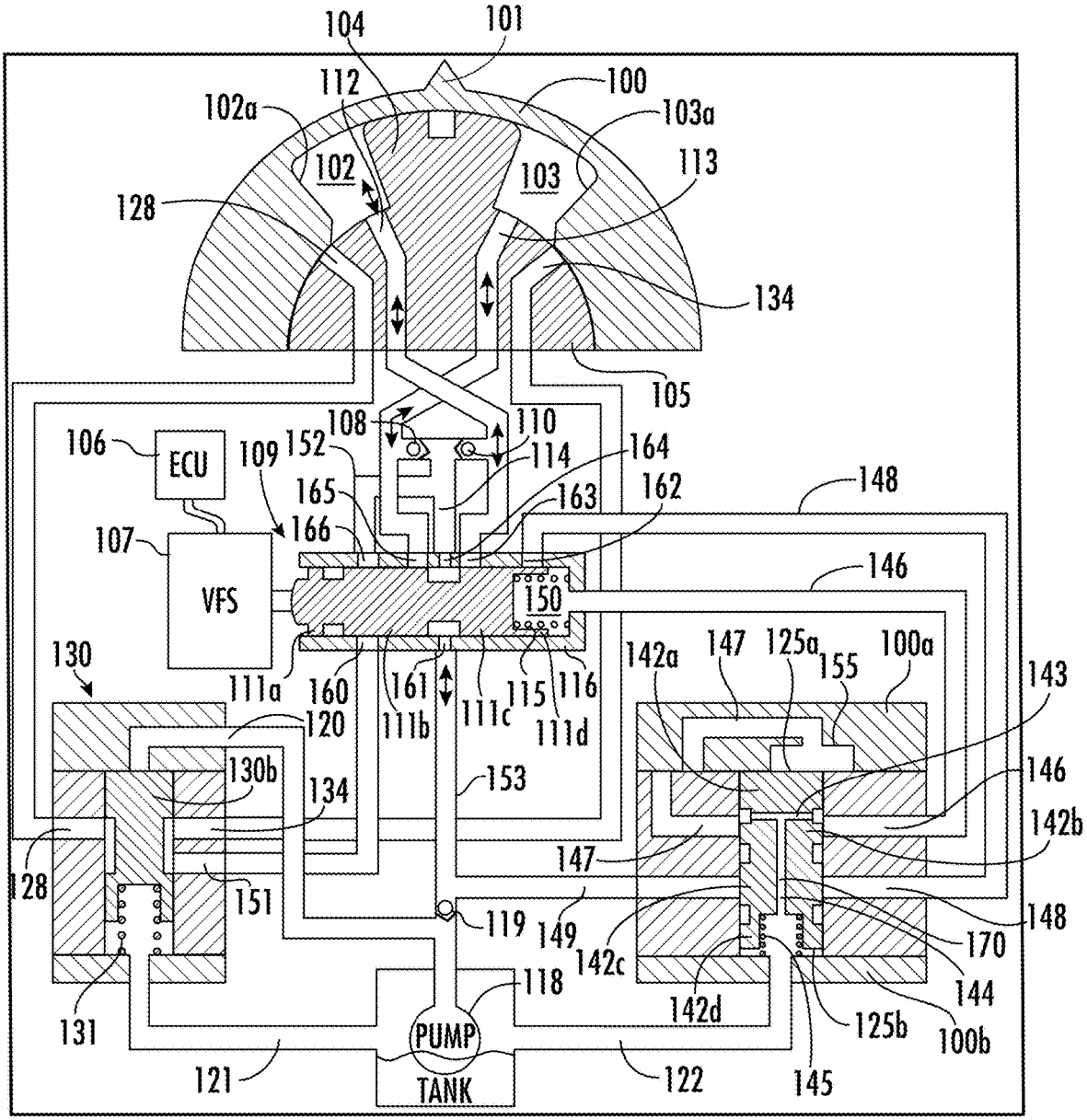
FIG. 3 shows a schematic of a VCT phaser at cranking in a holding position with the lock pin being unlocked.

FIGS. 1-3 show the VCT phaser at cranking RPM in which the VCT phaser is moved using cam torque actuation in a CTA cranking mode.

FIG. 1 shows a schematic of a VCT phaser at cranking moving toward a retard position by cam torque with the lock pin being unlocked. During engine cranking, the spool 111 of the control valve 109 is moved to a position by the VFS 107, against the force of the spring 115, between the null position and the spool full in position.

During engine cranking, in order to unlock the lock pin, the lock pin 142 starts in the lock position as shown in FIG. 8. The phaser is at the full advance position. In the full advance position, the vane 104 contacts the retard wall 103*a* of the chamber 117. The duty cycle of VFS 107 starts at 0% and moves to greater than 60%, to force the control valve 109 to expel the fluid present in the pump chamber 150. Fluid present in the spool valve pump chamber 150 is pushed out of the chamber 150 and into line 146. From line 146, the fluid flows between lock pin lands 142*b* and 142*c* into line 147 and recess 155, which moves the lock pin 142 out of the recess 155 and against the force of the lock pin spring 145. Fluid is additionally provided from the inlet supply 118, through inlet check valve 119 and into line 149. From line 149, fluid flows between lock pin lands 142*c* and 142*d* to line 148, which supplies additional fluid to the spool valve pump chamber 150 until enough fluid has passed into recess 155 from the spool valve pump chamber 150 via lines 146, 147.

Once the lock pin 142 has been moved to an unlocked position as shown in FIG. 1, fill port 162 is blocked by spool land 111*d*, removing additional fluid being supplied by line 148 from inlet supply 118. It is noted that with the spool valve chamber 150 vented, the spool 111 can move to other positions in which the spool valve chamber 150 is compressed. In addition, any fluid present in line 146 is now in fluid communication with the internal t-passage 170 between lock pin lands 142*a*, 142*b* and vents through passage 144 through the end of the spool 125*b* to tank via line 122.

After the lock pin 142 has been unlocked, the ECU 106 controls the VFS 107 to a position against the force of spring 115 in which the spool land 111*b* blocks ports 160, 165 and 166, spool land 111*c* blocks fill port 162, and ports 163, 164 and 161 are open. Fluid from the advance chamber 102 exits the advance chamber 102 through advance line 112 to port 163 of the sleeve 116. From port 163, fluid flows though the spool 111 between spool lands 111*b* and 111*c*, through port 164 into common line 114. From the common line 114, fluid flows through the retard recirculation check valve 108, into retard line 113 to the retard chamber 103, moving the vane 104 towards the advance wall 102*a* of the chamber 117 with the aid of cam torque in the same direction. It is noted that in this position, fluid is prevented from flowing into the common line 114 directly from the advance line 112 by advance recirculation check valve 110.

Since fluid is not supplied by the inlet supply 118, the detent valve 130 is biased by the spring 131 toward an on position in which fluid can flow through the detent valve 130 from line 151, the advance detent line 128 and the retard detent line 134. It is noted that fluid from the retard chamber 103 can flow through the retard detent line 134, and through the detent valve 130, however the advance detent line 128 is blocked by the rotor assembly 105 and line 151 connected to the retard detent line 134 and the advance detent line 128 through the detent valve 130 is blocked by spool land 111*b*.

FIG. 2 shows a schematic of a VCT phaser at cranking moving toward an advance position by cam torque with the lock pin being unlocked.

After the lock pin 142 has been unlocked, the ECU 106 controls the VFS 107 to a position against the force of spring 115 in which the spool land 111*b* blocks ports 160 and 166, spool land 111*c* blocks port 163 and partially blocks fill port 162 and ports 164, 165 and 161 are open.

Fluid from the retard chamber 103 exits the chamber 103 through retard line 113 to port 165 of the sleeve 116. From port 165, fluid flows though the spool 111 between spool lands 111*b* and 111*c*, through port 164 into common line 114. From the common line 114, fluid flows through the advance recirculation check valve 110, into advance line 112 to the advance chamber 102, moving the vane 104 towards the retard wall 103*a* of the chamber 117 with the aid of cam torque in the same direction. It is noted that in this position, fluid is prevented from flowing into the common line 114 directly from the retard line 113 by retard recirculation check valve 108.

Since fluid is not supplied by the inlet supply 118, the detent valve 130 is biased by the spring 131 toward an "on" position in which fluid can flow through the detent valve 130 from line 151, the advance detent line 128 and the retard detent line 134. It is noted that fluid from the advance chamber 102 can flow through the advance detent line 128, and through the detent valve 130, however the retard detent line 134 is blocked by the rotor assembly 105 and line 151 connected to the retard detent line 134 and advance detent line 128 through the detent valve 130 is blocked by spool land 111*b*.

FIG. 3 shows a schematic of a VCT phaser at cranking in a holding position with the lock pin being unlocked.

After the lock pin 142 has been unlocked, the ECU 106 control the VFS 107 to a position against the force of spring 115 in which the spool land 111*b* blocks ports 166, 165 160, and spool land 111*c* blocks fill port 162 and 163. Ports 161 and 164 are open. Fluid from the advance chamber 102 is blocked from flowing through the control valve 109 by spool land 111*c* and fluid from the retard chamber 103 is blocked from flowing through the control valve 109 by spool land 111*b*. Advance and retard recirculation check valve 108, 110 also prevent fluid from the advance and retard chambers 102, 103 from entering the common line 114.

Since fluid is not supplied by the inlet supply 118, the detent valve 130 is biased by the spring 131 toward an "on" position in which fluid can flow through the pilot valve 130 from the blocked advance detent line 128 and the blocked retard detent line 134.

FIGS. 4-7 show the VCT phaser at cranking RPM in which the VCT phaser is moving toward a mid-position using cam torque actuation in a mid-position cranking mode.

Figure 4:
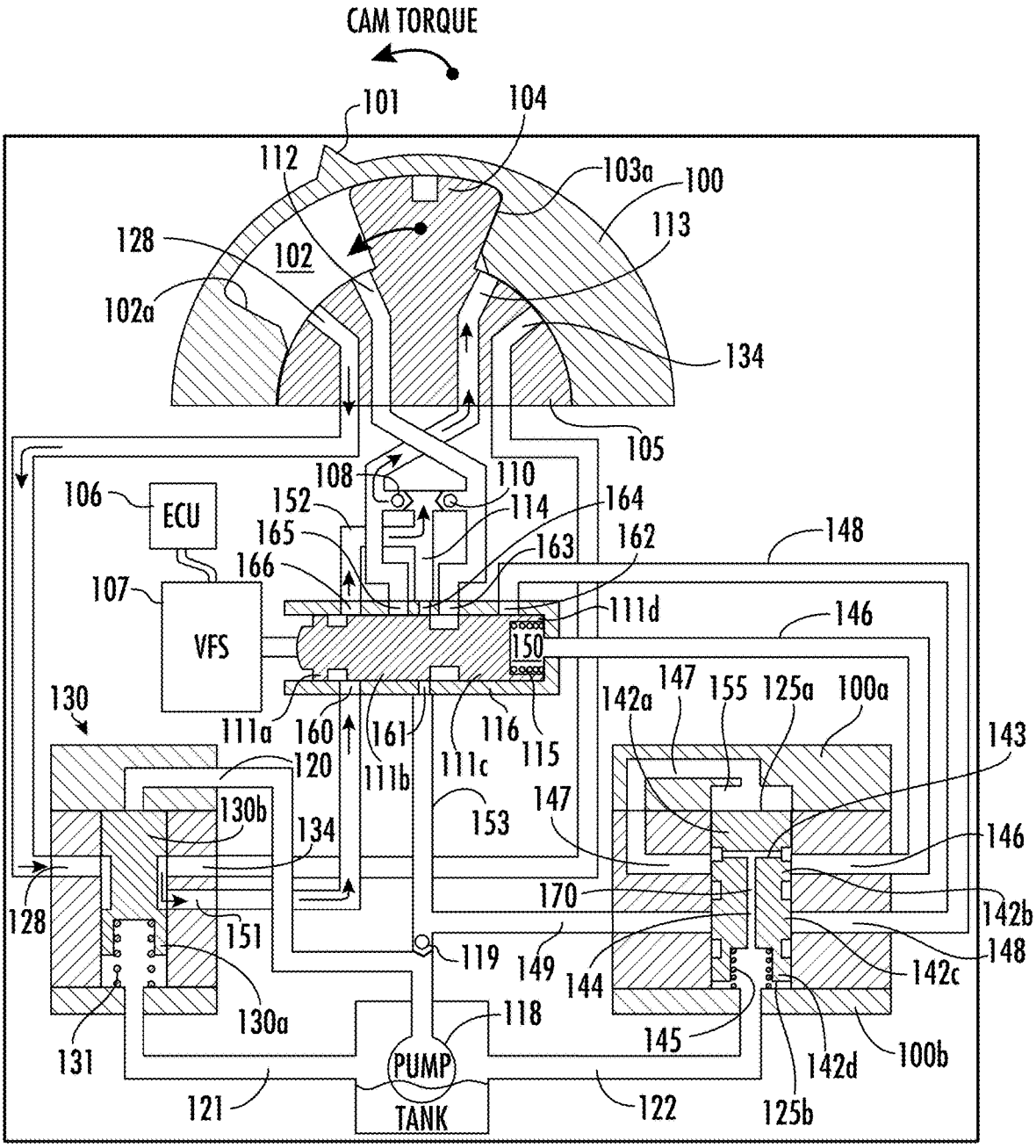
FIG. 4 shows a schematic of a VCT phaser at cranking retarding toward a mid position by cam torque with the lock pin being unlocked.
Figure 5:
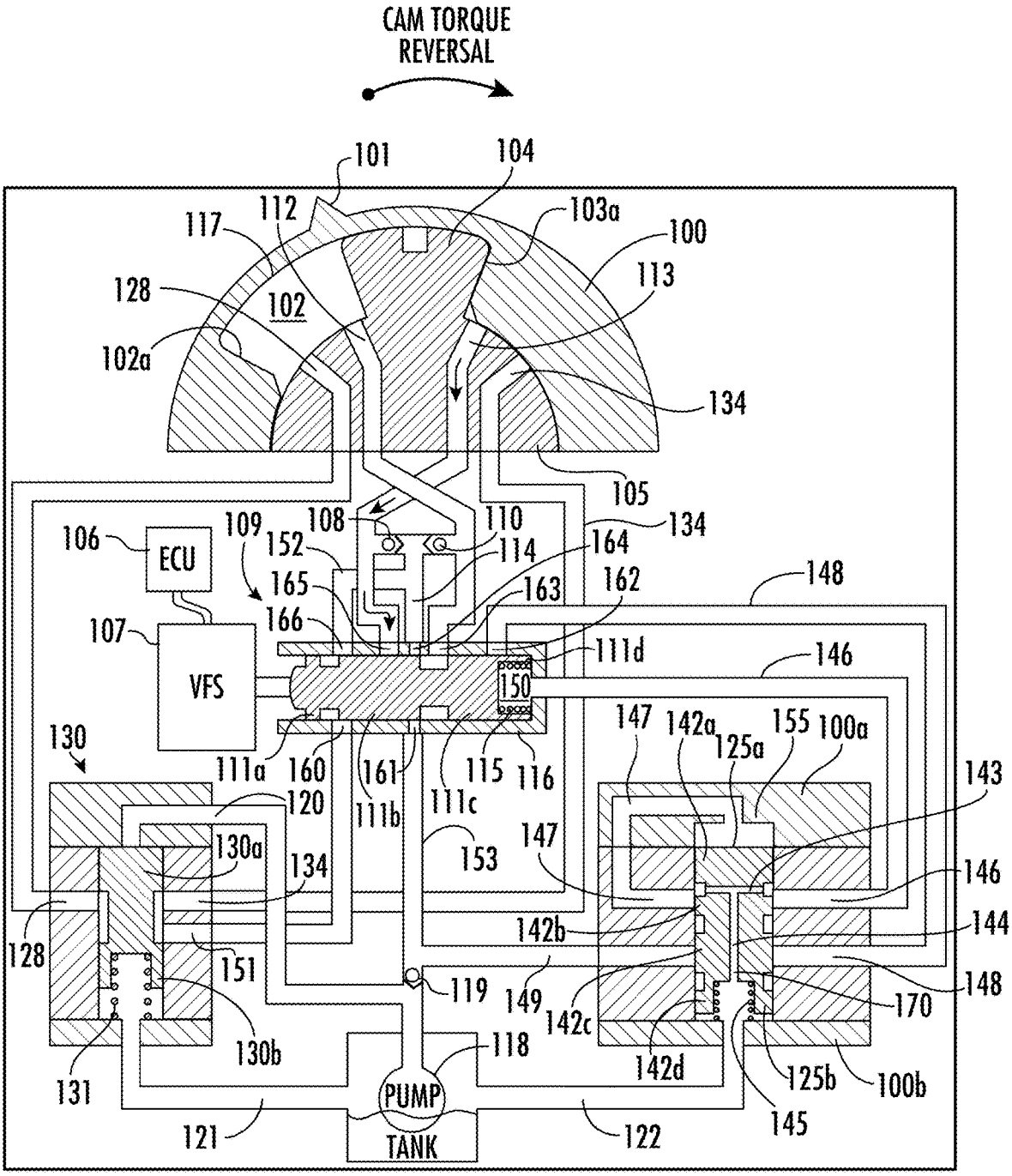
FIG. 5 shows a schematic of a VCT phaser at cranking retarding toward a mid position during a cam torque reversal.

FIG. 4 shows the VCT phaser at cranking RPM moving toward the mid position from an advance position (retarding). FIG. 5 shows the VCT phaser at cranking moving toward the mid position from an advance position during a cam toque reversal.

During cranking, the VCT phaser is moved from an initial full advance position in which the vane 104 contacts the retard wall 103*a* to a mid-position between the advance wall 102*a* and the retard wall 103*a* in the same direction as the cam torque which in this case is toward the advance wall 102*a*.

First, the ECU 106 controls the VFS 107 such that the spool 111 of the control valve 109 is moved to a position which pumps the spool valve chamber 150 and forces fluid present in the spool valve chamber 150 to flow through line 146, through the horizontal portion 143 of the t-passage 170 of the lock pin 142, through line 147 into recess 155 to bias the lock pin 142 against spring 145, such that the lock pin 142 is moved to an unlocked position in which the lock pin 142 no longer engages recess 155. Once the lock pin 142 has been moved to an unlocked position, the fill line 149 in communication with the inlet supply 118 is blocked along with the fill line 148 in communication with fill port 162 for filling the spool valve pump chamber 150.

The spool 111 is then moved to a position by the VFS 107 via the ECU 106 in which all supply lines, supply line 153 from the inlet supply 118, and supply line 148 to the spool valve pump chamber 150 are blocked. Additionally, the spool 111 blocks the flow of fluid through the common line 114 from port 164.

Fluid present in the advance chamber 102 exits the advance chamber 102 through the advance detent line 128 and flows through the pilot valve 130 between the first land 130*a* and the second land 130*b*. From the pilot valve 130, fluid flows to recirculation line 151 to port 160 of the spool valve, between spool lands 111*a* and 111*b* to port 166 and line 152 which is connected to common line 114. From common line 114, fluid flows through the advance recirculation check valve 108 and into retard line 113 and the retard chamber 103 to move vane 104 toward the advance wall 102*a*. The vane 104 continues to move toward the advance wall 102*a* until the advance detent line 128 is no longer exposed to the advance chamber 102 and is blocked by the housing assembly 100.

FIG. 5 shows the VCT phaser of FIG. 4 during a cam torque reversal. During a cam torque reversal, which in this case has the cam torque attempting to move the vane 104 towards the retard wall 103*a*, the position of the VCT phaser is essentially held in place, with any fluid that that is moved to exit the retard chamber 103 by the cam torque reversal is prevented by the spool land 111*b* blocking line 113.

Figure 6:
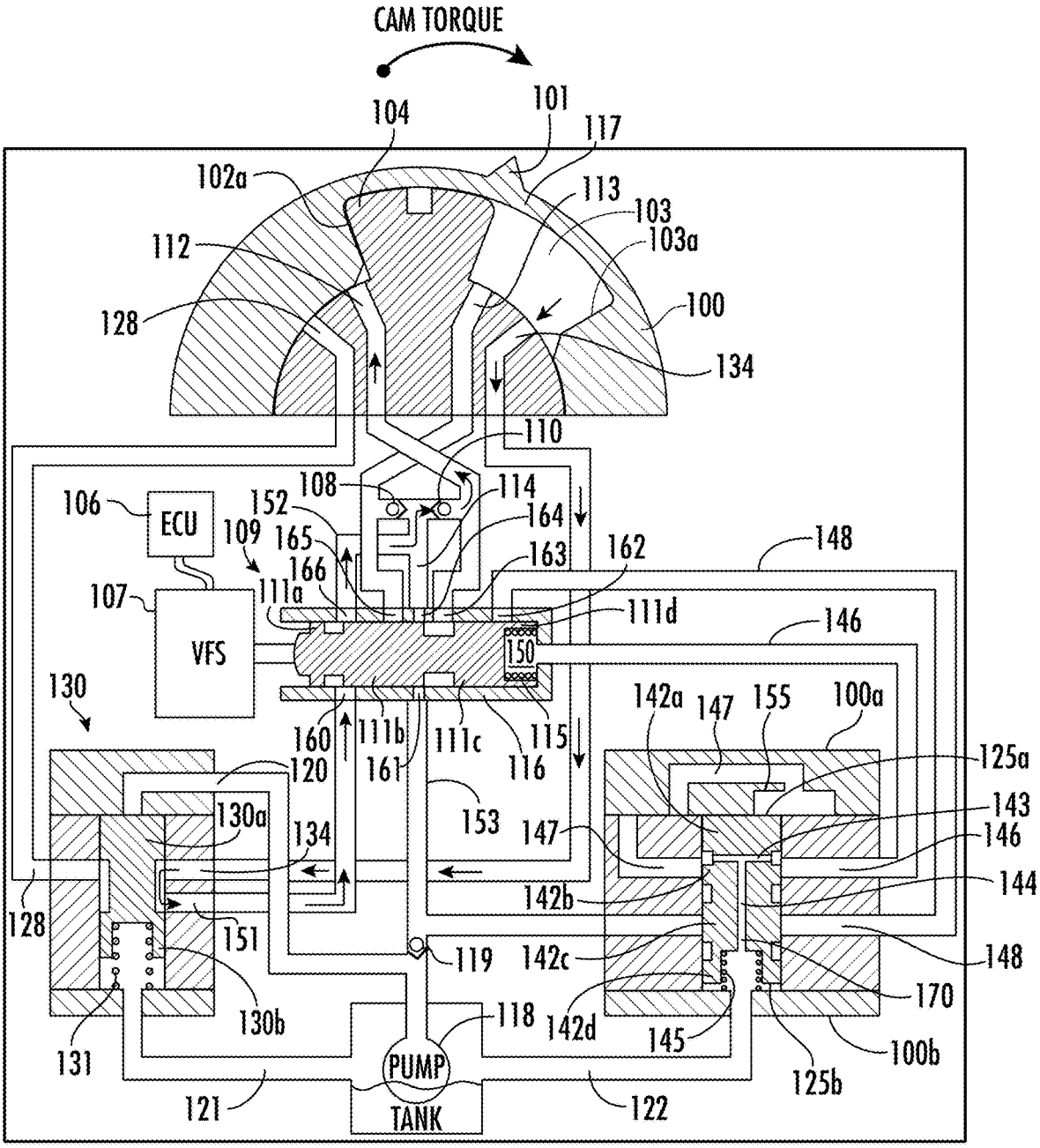
FIG. 6 shows a schematic of a VCT phaser at cranking advancing toward a mid position with the lock pin being unlocked.
Figure 7:
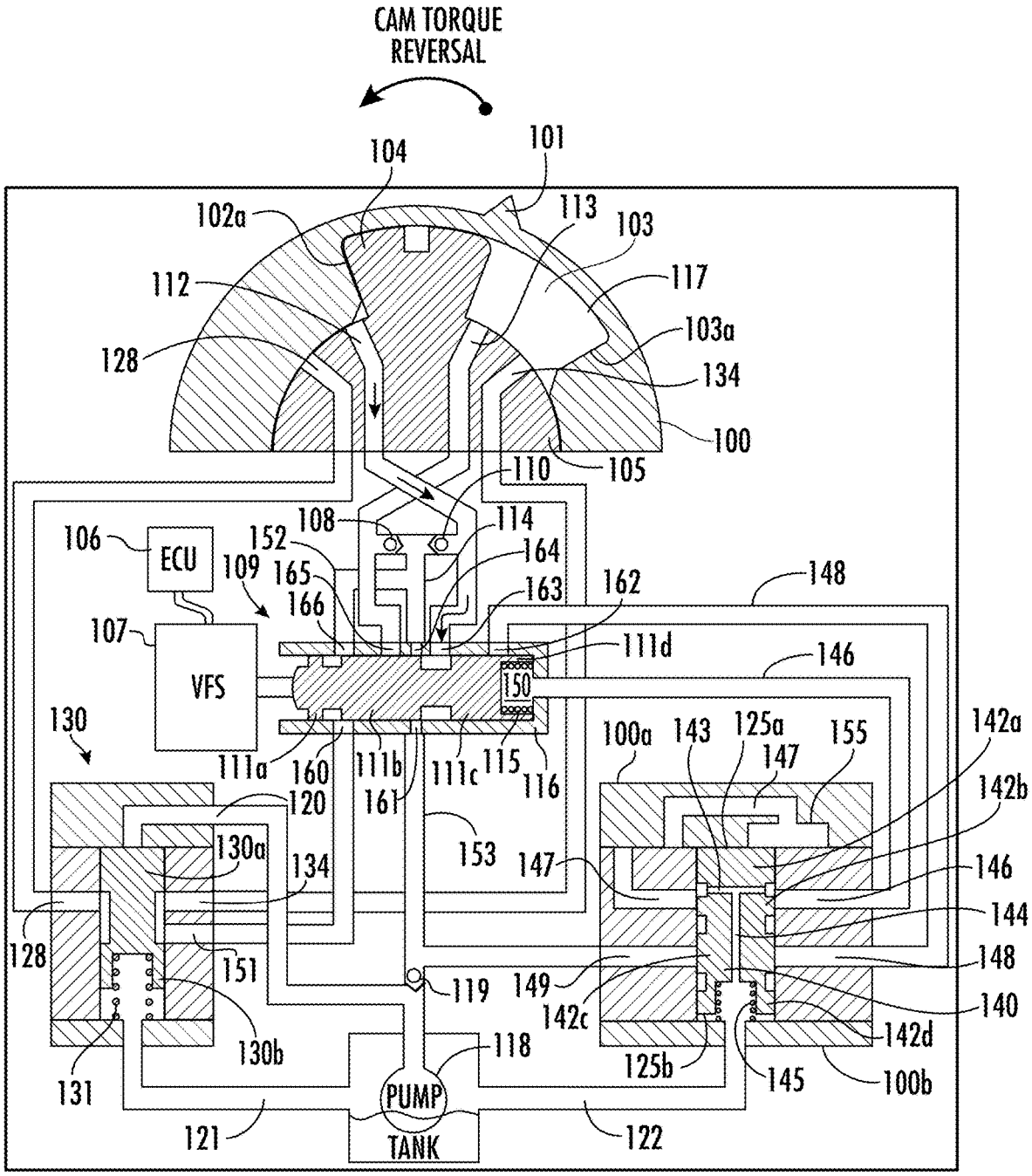
FIG. 7 shows a schematic of a VCT phaser at cranking advance towards mid position during a cam torque reversal.

FIG. 6 shows the VCT phaser at cranking RPM moving toward mid position from a retard position (advancing). FIG. 7 shows the VCT phaser at cranking moving toward the mid position from a retard position during a cam torque reversal.

During cranking, the VCT phaser is moved from an initial full retard position in which the vane 104 contacts the advance wall 102*a* to a mid-position between the advance wall 102*a* and the retard wall 103*a* in the same direction as the cam torque, which in this case is toward the retard wall 103*a*.

First, the ECU 106 controls the VFS 107 such that the spool 111 of the control valve 109 is moved to a position which pumps the spool valve chamber 150 and forces fluid present in the spool valve chamber 150 to flow through line 146, through the horizontal portion 143 of the t-passage 170 of the lock pin 142, through line 147, into recess 155 to bias the lock pin 142 against spring 145, such that the lock pin 142 is moved to an unlocked position in which the lock pin 142 no longer engages recess 155. Once the lock pin has been moved to an unlocked position, the fill line 149 in communication with the inlet supply 118 is blocked along with the fill line 148 in communication with fill port 162 for filling the spool valve chamber 150.

The spool 111 is then moved to a position by the VFS 107 via the ECU 106 in which all supply lines, supply line 153 from the inlet supply 118, and supply line 148 to the spool valve chamber 150 are blocked. Additionally, the spool 111 blocks the flow of fluid through the common line 114 from port 164.

Fluid present in the retard chamber 103 exits the retard chamber 103 through the retard detent line 134 and flows through the pilot valve 130 between the first land 130*a* and the second land 130*b*. From the pilot valve 130, fluid flows to recirculation line 151 to port 160 of the spool valve, between spool lands 111*a* and 111*b* to port 166 and line 152 which is connected to common line 114. From common line 114, fluid flows through the retard recirculation check valve 110 and into advance line 112 and the advance chamber 102 to move vane 104 toward the retard wall 103*a*. The vane 104 continues to move toward the retard wall 103*a* until the retard detent line 134 is no longer exposed to the retard chamber 103 and is blocked by the housing assembly 100.

FIG. 7 shows the VCT phaser of FIG. 6 during a cam torque reversal. During a cam torque reversal, which in this case has the torque attempting to move the vane 104 towards the advance wall 102*a*, the position of the phaser is essentially held in place, with any fluid that that is moved to exit the advance chamber 102 by the cam torque reversal is prevented by the spool land 111*b* blocking line 112.

Figure 9:
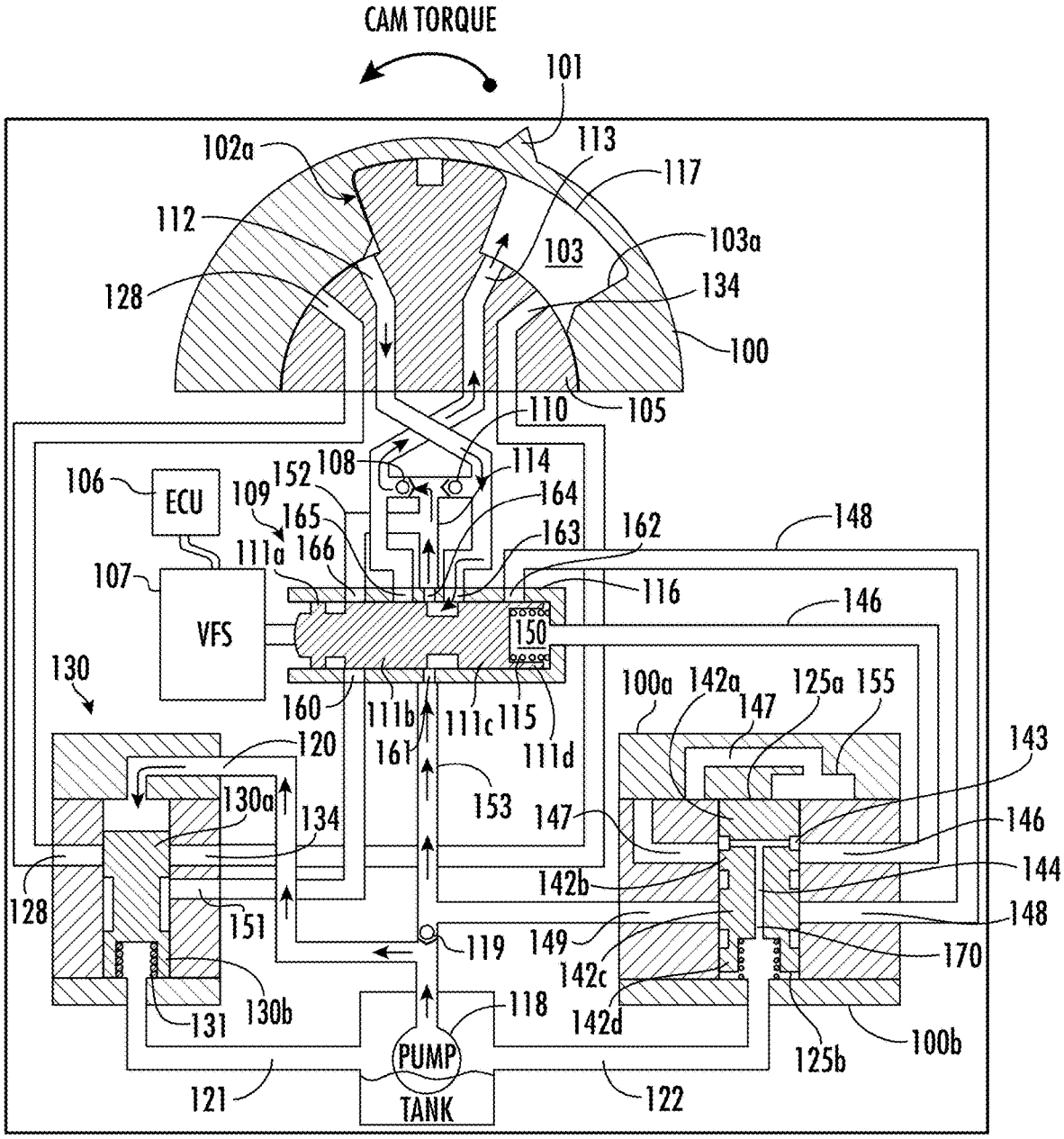
FIG. 9 shows a schematic of a VCT phaser at idle moving toward the retard position.
Figure 10:
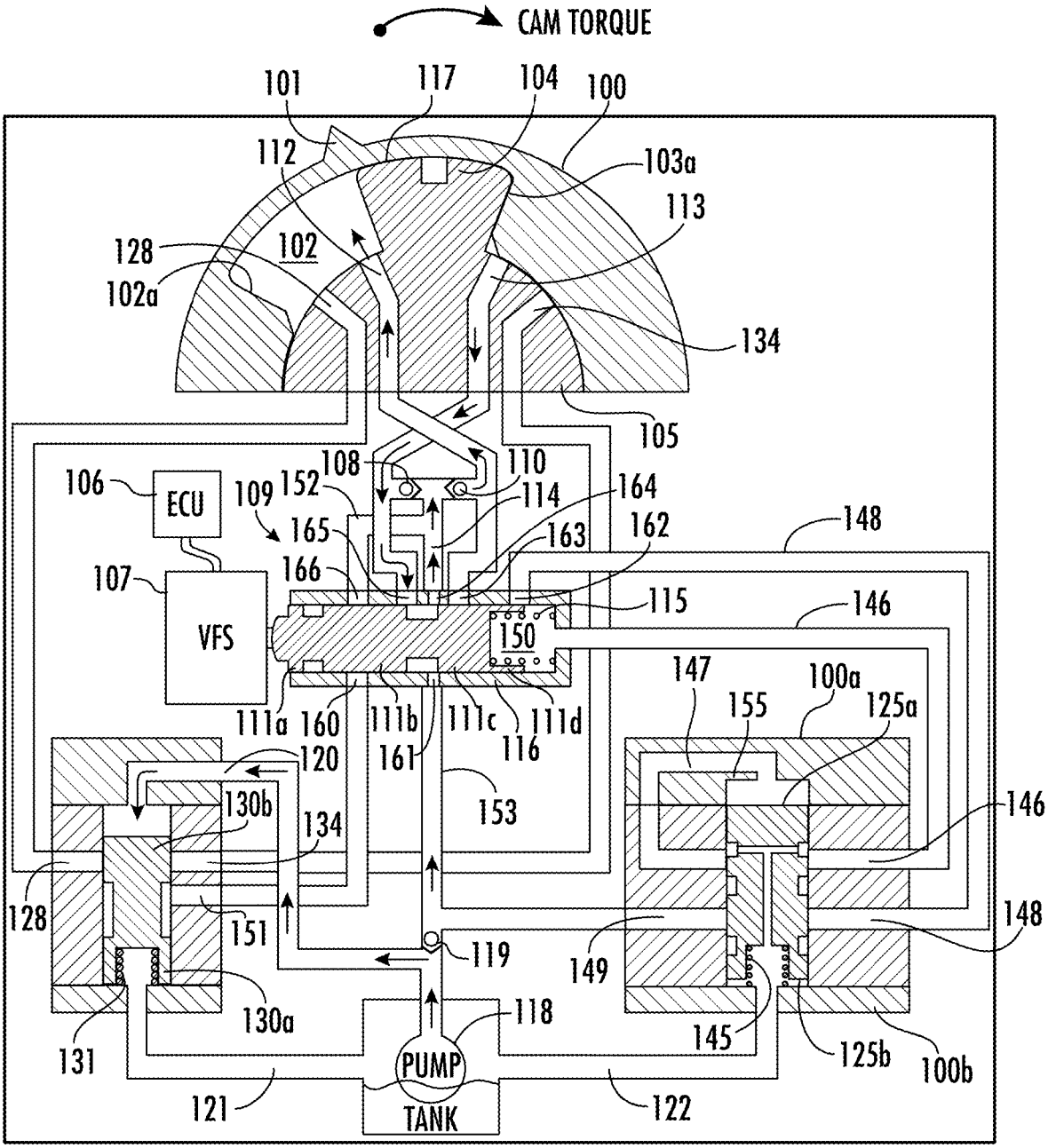
FIG. 10 shows a schematic of a VCT phaser at idle moving toward an advance position.
Figure 11:
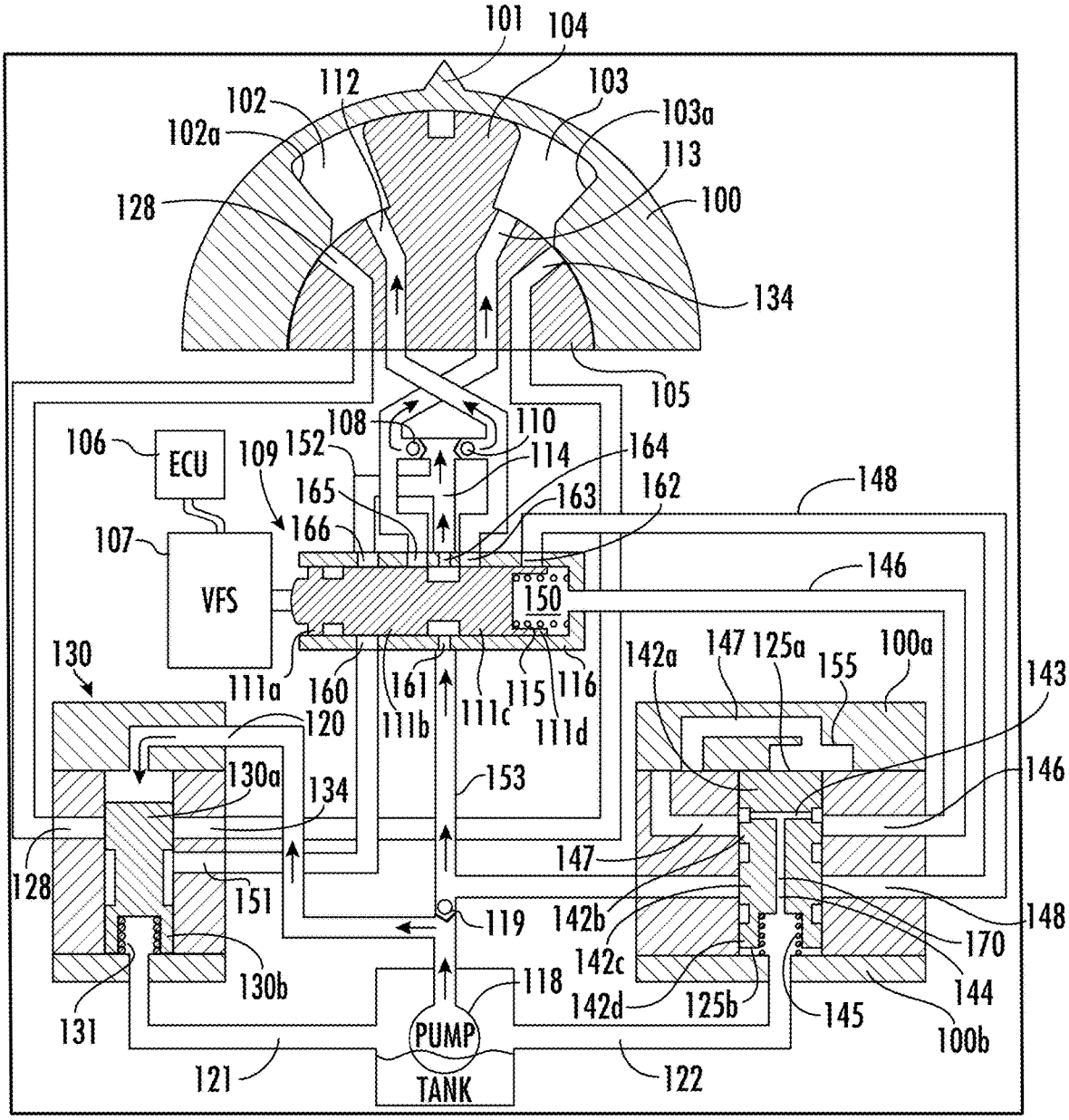
FIG. 11 shows a schematic of a VCT phaser at idle in a holding position.
Figure 12:
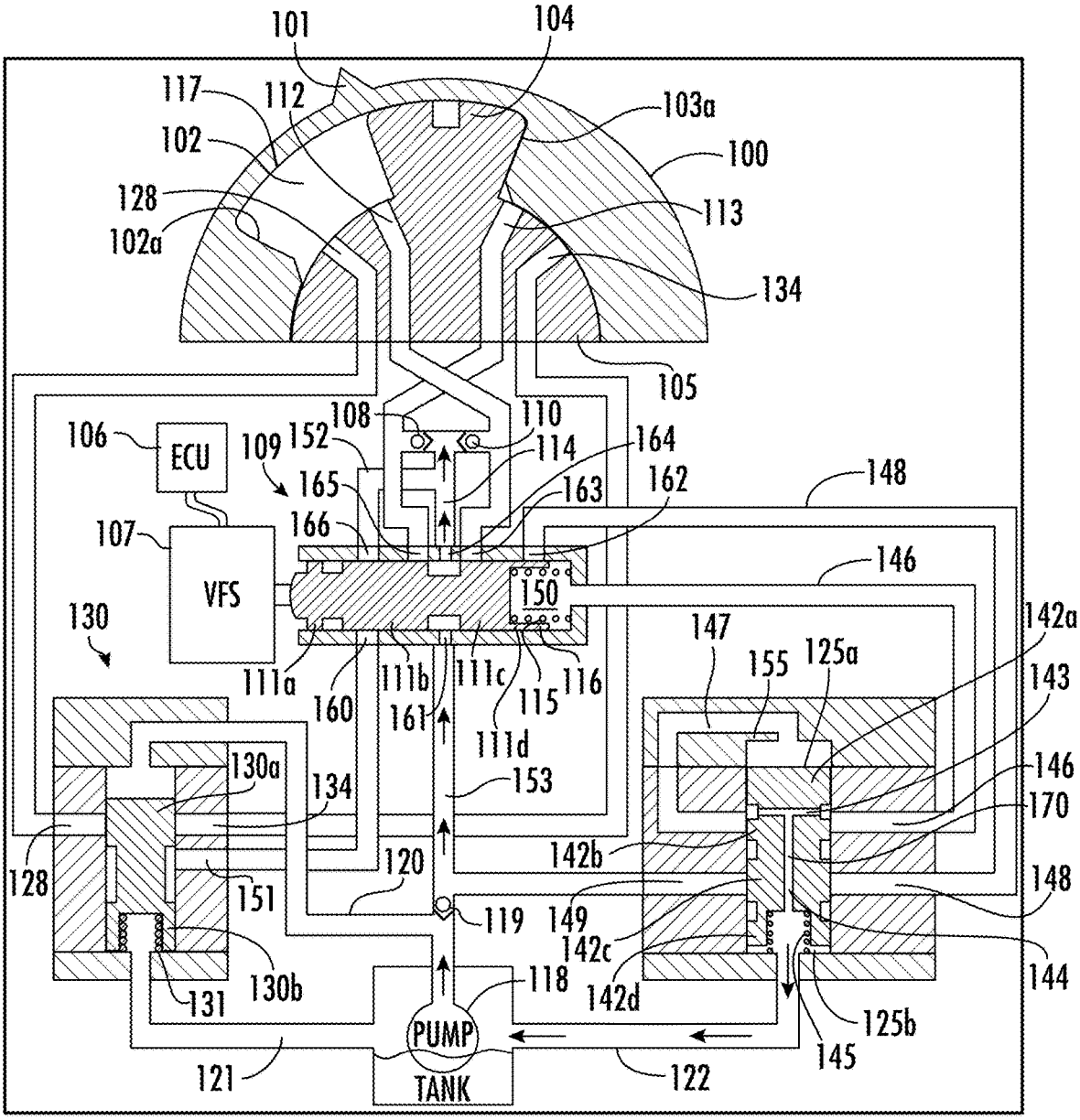
FIG. 12 shows a schematic of a VCT phaser at idle with the lock pin moving from unlocked to locked.

FIGS. 9-12 show the VCT phaser modes at idling. FIG. 9 shows the VCT phaser moving toward a retard position in the retard mode. FIG. 10 shows a schematic of a VCT phaser at idle moving toward an advance position. FIG. 11 shows a schematic of a VCT phaser at idle in a holding position. FIG. 12 shows a schematic of a VCT phaser at idle with the lock pin moving from unlocked to locked.

Referring to FIG. 9, to move towards the retard position, the duty cycle is adjusted to a range greater than 60% of the force of the VFS 107 on the spool 111 is changed and the spool 111 is moved to the right in a retard mode in the figure by VFS 107, until the force of the VFS 107 balances the force of the spring 115. Fluid exits from the advance chamber 102 through advance line 112 to port 163. From port 163, fluid flows through port 164 to common line 114. From common line 114, fluid flows through the retard recirculation check valve 108, into retard line 113 and the retard chamber 103.

Makeup oil or source is supplied to the phaser from source inlet supply 118 into inlet line 153, and detent supply line 120. Detent supply line 120 moves the pilot valve to a closed position, against the force of spring 131, such that detent land 130*b* blocks the flow of fluid between the advance detent line 128 and the retard detent line 134.

Makeup oil or source 118 provided to inlet line 153 moves through inlet check valve 119 and through port 161 of the control sleeve 116. From port 161, fluid flows between spool lands 111*b* and 111*c* to the common line 114. From the common line 114, fluid flows through the retard recirculation check valve 108 and through line 113 to the retard chamber 103.

The lock pin 142 maintains the unlocked position from during cranking.

FIG. 10 shows the VCT phaser moving toward the advance position. To move to the advance position, the duty cycle is less than 60% of the force of the VFS 107 on the spool 111 is changed and the spool 111 is moved to the left in an advance mode in the figure by the VFS 107, until the force of the VFS 107 balances the force of the spring 115. Fluid exits from the retard chamber 103 through retard line 113 to port 165. From port 165, fluid flows through port 164 to common line 114. From common line 114, fluid flows through the advance recirculation check valve 110, into advance line 112 and into the advance chamber 102.

Makeup oil or source is supplied to the phaser from source inlet supply 118 into inlet line 153 and detent supply line 120. Detent supply line 120 moves the pilot valve 130 to a closed position, against the force of spring 131, such that detent land 130*b* blocks the flow of fluid between the advance detent line 128 and the retard detent line 134.

Makeup oil or source 118 provided to inlet line 153 moves through inlet check valve 119 and through port 161 of the control sleeve 116. From port 161, fluid flows between spool lands 111*b* and 111*c* to the common line 114. From the common line 114, fluid flows through the advance recirculation check valve 110 and through advance line 112 to the advance chamber 102.

The lock pin 142 maintains the unlocked position from during cranking.

FIG. 11 shows the VCT phaser in a holding position. Makeup oil or source 118 provided to inlet line 153 moves through inlet check valve 119 and through port 161 of the control sleeve 116. From port 161, fluid flows between spool lands 111*b* and 111*c* to the common line 114. From the common line 114, fluid flows through the retard check valve 110 and through advance line 112 to the advance chamber 102 or to the advance check valve 108 and through the retard line 113 to the retard chamber 103.

In the holding position, fluid is additionally supplied from source inlet supply 118 into inlet line 153 and detent supply line 120. Detent supply line 120 moves the pilot valve to a closed position, against the force of spring 131, such that detent land 130*b* blocks the flow of fluid between the advance detent line 128 and the retard detent line 134.

The lock pin 142 maintains the unlocked position from during cranking.

FIG. 12 shows the VCT phaser at idle with the lock pin moving from an unlocked position to a locked position.

Fluid communication through fill port 162 between line 148 and the spool valve pump chamber 150 is blocked by spool land 111*d*. With fill port 162 blocked, fluid cannot enter the spool valve pump chamber 150 and also cannot flow to recess 155. Therefore, no pressurization of the spool 111 or lock pin 142 to bias the lock pin 142 to an open position can occur. Any fluid that is present in recess, line 147 or line 146 are vented to through the internal t-passage 170 of the lock pin through the second end 125*b* of the lock pin 142 and through line 122 to tank. Once the first end 125*a* of the lock pin 142 is aligned with the recess 155, the lock pin spring 145 biases the lock pin 142 into the recess 155.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable cam timing phaser for an internal combustion engine, the variable cam timing phaser comprising:

a housing assembly configured to accept drive force and comprising an outer end plate and an inner plate;

a rotor assembly configured to connected to a camshaft having a plurality of vanes coaxially located within the housing assembly, wherein the housing assembly and the rotor assembly define at least one chamber separated by a vane of the plurality of vanes into working fluid chambers, with motion of the vane within the at least one chamber acting to shift a relative angular position of the housing assembly and the rotor assembly;

a control valve configured to move between multiple positions, for directing fluid from a fluid input to and from a spool valve vent chamber supply line and a spool valve vent chamber vent line and directed fluid from the fluid input to and from an advance chamber and an retard chamber through an advance line, a retard line, a supply line coupled to the fluid input, a detent valve line, an advance detent line, and a retard detent line, the control valve comprising: a spool slidable received within a sleeve having a pump chamber as to accumulate a volume of fluid defined between the spool and the sleeve, the control valve being moveable through multiple modes;

a detent valve in fluid communication with the control valve via the advance detent line, the retard detent line, and the detent valve line, the detent valve moveable between a first position in which fluid from the control valve can flow from either one of the advance detent line or the retard detent line through the detent valve and the detent valve line, to a remaining of the advance detent line or the retard detent line and a second position in which fluid is prevented from flowing from the control valve through the detent valve to either of the advance detent line or the retard detent line;

a lock pin slidable located in one of the rotor assembly or the housing assembly, the lock pin configured to move from an unlocked position in which a first end portion of the lock pin does not engage a lock pin recess in a remaining one of the rotor assembly or the housing assembly, to a locked position in which the first end portion of the lock pin engages the lock pin recess, locking the relative angular position of the housing assembly and the rotor assembly at a locked position, the lock pin comprising:

a body having the first end portion, a second end portion, opposite the first end portion and a plurality of lands;

a t-shaped passage within the body, with a horizontal portion of the t-shaped passage being present between at least two of the plurality of the lands, and a vertical portion of the t-shaped passage extended from the horizontal portion to the second end portion of the body;

a spring biasing the second end portion towards the recess;

wherein when the engine is at a cranking, the control valve is in one of a cam torque actuated retard cranking mode, a detent cranking mode and a full advance cranking mode, such that:

in the cam torque actuated retard cranking mode, the spool is moved from a position in which fluid present in a spool valve pump chamber flows through the spool valve vent chamber vent line through the lock pin and into the recess to move the lock pin from a closed position to an open position and until the spool is in a position in which a spool valve vent supply line is blocked and fluid from the advance chamber flows through the control valve to the retard chamber;

in the detent cranking mode, the spool is moved from a position in which fluid present in the spool valve pump chamber flows through the spool valve vent chamber vent line through the lock pin and into the recess to move the lock pin from a closed position to an open position and until the spool is in a position in which the spool valve vent supply line is blocked, the detent valve line is open such that fluid can flow from either the advance detent line or retard detent line, through the detent valve and into the advance chamber or the retard chamber and the detent valve; and in the full advance cranking mode, the spool is moved from a position in which fluid present in the spool valve pump chamber flows through the spool valve vent chamber vent line through the lock pin and into the recess to move the lock pin from a closed position to an open position and until the spool is in a position in which the spool valve vent supply line is blocked and fluid from the retard chamber flows through the control valve to the advance chamber.

2. The variable cam timing phaser of claim 1, wherein in the cam torque actuated retard cranking mode, fluid is supplied from the fluid input, through the lock pin and into the spool valve pump chamber via the spool valve vent chamber supply line until the spool blocks the spool valve vent chamber supply line.

3. The variable cam timing phaser of claim 1, wherein the recess of the lock pin is located in the inner plate or the outer plate of the housing assembly.

4. The variable cam timing phaser of claim 1, wherein the recess of the lock pin is located in the rotor assembly.

5. The variable cam timing phaser of claim 1, wherein to move the lock pin from the open position to the closed position, fluid in the recess flows into the t-shaped passage within the body of the lock pin and out the second end portion of the lock pin, such that the spring biases the first end portion towards the recess.

6. The variable cam timing phaser of claim 1, wherein in the cam torque actuated retard cranking mode and the full advance cranking mode, the detent valve is in the second position.

7. The variable cam timing phaser of claim 1, wherein in the detent cranking mode, the detent valve is in the first position.

8. The variable cam timing phaser of claim 1, wherein one the multiple modes of the control valve is an advance mode in which fluid is routed from the retard chamber to the advance chamber through a retard recirculation check valve and fluid from the fluid input biases the detent valve to the second position.

9. The variable cam timing phaser of claim 8, wherein the advance mode is during engine idle.

10. The variable cam timing phaser of claim 1, wherein one the multiple modes of the control valve is a retard mode in which fluid is routed from the advance chamber to the retard chamber through an advance recirculation check valve and fluid from the fluid input biases the detent valve to the second position.

11. The variable cam timing phaser of claim 10, wherein the retard mode is during engine idle.

12. The variable cam timing phaser of claim 1, wherein one of the multiple modes of the control valve is a holding mode in which fluid is routed to the advance chamber and the retard chamber from the inlet supply and the detent valve is in the second position.

13. The variable cam timing phaser of claim 12, wherein the holding mode is during engine idle.

* * * * *